United States Patent [19]

May

[11] Patent Number: 4,643,331

[45] Date of Patent: Feb. 17, 1987

[54] COMMERCIAL WASTE CONTAINER AND DISPOSAL UNIT

[75] Inventor: Robert A. May, Beeville, Tex.

[73] Assignee: May Fabricating Co., Inc., Beeville, Tex.

[21] Appl. No.: 848,455

[22] Filed: Apr. 4, 1986

[51] Int. Cl.[4] ..... B65D 45/16

[52] U.S. Cl. ..... 220/324; 292/111; 292/257

[58] Field of Search ..... 220/324, 1.5; 292/111, 292/257, 65, 7, 26, 113; 105/406; 100/99, 100, 299; 414/411, 408, 406

[56] References Cited

U.S. PATENT DOCUMENTS

| | | | |
|---|---|---|---|
| 1,165,493 | 12/1915 | Clark . | |
| 1,579,673 | 1/1926 | Tench . | |
| 2,961,262 | 11/1960 | Nockels | 292/113 |
| 3,059,789 | 10/1962 | Bowles | 214/41 |
| 3,211,493 | 10/1965 | Mandel | 296/50 |
| 3,318,624 | 5/1967 | Poe | 292/113 |
| 3,441,166 | 4/1969 | DeFrees | 220/324 |
| 3,476,425 | 11/1969 | Chartrand | 292/113 |
| 3,514,009 | 5/1970 | Emery et al. | 220/324 |
| 3,664,696 | 5/1972 | Poe | 292/26 |
| 3,713,400 | 1/1973 | Teoli | 105/406 |
| 3,776,144 | 12/1973 | Eislers | 105/406 |
| 3,844,591 | 10/1985 | Velcover | 292/7 |
| 3,880,072 | 4/1975 | Ord | 100/100 |
| 4,089,435 | 5/1979 | Corompt | 214/304 |
| 4,147,264 | 4/1979 | Harvey | 414/411 |
| 4,157,146 | 6/1979 | Svenson | 220/324 |
| 4,182,530 | 1/1980 | Hodge | 294/73 |
| 4,184,424 | 1/1980 | Yeager | 100/99 |
| 4,352,624 | 10/1982 | Matsumoto | 414/400 |
| 4,391,188 | 4/1983 | Gwathney | 100/299 |
| 4,408,542 | 10/1983 | Heap | 105/406 |
| 4,552,500 | 11/1985 | Ghibaudo | 414/408 |

*Primary Examiner*—George T. Hall
*Attorney, Agent, or Firm*—Vaden, Eickenroht, Thompson & Boulware

[57] ABSTRACT

An improved commercial waste container and disposal unit comprised of a bottom plate rounded upward along the sides and welded to side pieces so that the weld and side pieces are unlikely to contact fluids collecting in the bottom of the container. The end door through which waste is emptied is securely latched to the container by such means that a handler may quickly and efficiently unlatch the door by virtue of mechanical means attached to the side of the container a distance away from the door, thereby preventing the handler from being contaminated by seeping waste.

5 Claims, 7 Drawing Figures

COMMERCIAL WASTE CONTAINER AND DISPOSAL UNIT

BACKGROUND OF THE INVENTION

1. Field of the Invention

This invention relates to commercial waste containers and disposal units. More particularly, this invention relates to an improved container less likely to contaminate its surroundings during storage and its handler during dumping.

2. Description of the Prior Art

Commercial waste containers and disposal units are traditionally constructed in box shape with structure reinforced by longitudinally spaced channels. Waste is deposited through the top of the container which may be enclosed by secured hatches. The bottom of the container is traditionally constructed of heavier weight material, as for instance of 96 inch wide one-quarter inch steel plate. The standard width of the containers usually conforms to the standard width of commercial metal plate. Several inches are allowed for forming corners.

By virtue of structural means located along the bottom and one end of the container, the container may be periodically hoisted onto a specially constructed truck, or truck and trailer, for transportation, dumping and return. Not all waste materials clear from current art containers during the dumping operation. Residual waste that is trapped in the bottom decomposes and contributes to the rusting through of the bottom of the container. One reason the container is constructed with a bottom plate of greater thickness is to forestall this rusting through. Eventually, the bottom leaks. Frequently the bottom leaks along a weld line. The environment may be contaminated. The container must be repaired or replaced.

Dumping is accomplished by opening a door comprising one end of the container, raising the other end of the container and permitting the waste to slide through the open door. Releasing the seal on the door, even while the container is level, results in a seepage of contents. The handler of the dumping operation is typically contaminated by this process by virtue of the location of the means required to release the seal of the door.

Increased concern for environmental protection, especially against hazardous waste, makes contamination of the environment and handlers by waste from commercial containers undesirable.

Therefore, it is a feature of the present invention to provide an improved waste container and disposal unit that reduces the possibility of contamination of the environment or handlers by leakage or spillage during storage or dumping.

It is feature of the present invention to provide a commercial waste container that dumps more thoroughly, thereby trapping less rust fostering materials.

It is another feature of the present invention to provide a commercial waste container more impervious to rusting through.

It is another feature of the present invention to provide a means for the handler of the dumping operation to dump the waste without significant risk of being contaminated by the process.

It is another feature of the present invention to provide a standard volume waste container with greater durability and yet lighter weight.

SUMMARY OF THE INVENTION

Applicant's improved waste container and disposal unit provides a container composed of the standard bottom plate that is of greater relative thickness than the side pieces. At least two edges of Applicant's bottom plate are rounded upwards. The rounded upward edges are welded to side pieces at a point substantially above the bottom surface. The weld is thus placed above the bottom level where residual fluids collect. Standing fluids would contact only the thicker bottom plate, not the weld or the relatively thinner sides.

The absence of corner joints along the sides of the bottom results in the container dumping cleaner. Less residual waste results in less residual moisture retained in the container to foster rust. Again, any moisture that does remain fosters rust only along the thick bottom material.

By rounding up the side edges of the standard width bottom plate it is possible to achieve a container of equal volume to, yet of lighter weight than, current art containers. The present invention provides for the identical container width found in standard practice. Lighter weight is achieved by an economy in the square foot of side pieces required. Rounding up the bottom edges reduces the required square feet for side pieces even after allowance is made for lapping the side piece over the bottom plate for welding and for a slight increase in height to compensate for the loss of volume due to rounded bottom corners.

It might be noted that the above same features are not achieved by rounding downwards the edges of the sides. Rounding downward the lower edges of the sides places the weld and the thinner side material on the bottom. Moreover, rounding up the sides of the bottom in lieu of rounding down the bottom of the sides insures that surfaces liable to impact from the deposit from above of heavy waste are all constructed of the thicker bottom material.

The present invention provides that the edges of the side pieces that are to be welded to the rounded edges of the bottom have a lip. Double welding of the lip of the side pieces to the bottom plate results in a smooth exterior surface without external projections. The longitudinally spaced channeling adding support to the body conforms more smoothly to this surface.

The present invention provides for partially spherical corner pieces.

The present invention provides for a container unit having a dumping opening located on one end which is sealed by a door. The door is pressed securely against the container during storage by latching means. The invention provides latching means that may be quickly and efficiently released by a handler who applies mechanical force through mechanical connections located on one side of the container some distance away from the door opening. In this manner seepage out the loosened door does not touch the handler.

The latching means includes a latch bar which maintains the door either closed or open, the latch bar being moved by a swivel connection to a projection of a rotating latch rod. The latch bar rotates through and around a keeper fulcrum attached to the container. The latch rod is rotated by means of mechanical force applied to one end of mechanical connection means.

BRIEF DESCRIPTION OF THE DRAWINGS

So that the manner in which the above recited features, advantages and objects of the invention, as well as others which will become apparent, are attained and can be understood in detail, more particular description of the invention briefly summarized above may be had by reference to the embodiments which are illustrated in the drawings, which drawings form a part of this specification. It is to be noted, however, that the appended drawings illustrate only typical embodiments of the invention and are therefore not to be considered limiting of its scope, for the invention may admit to other equally effective embodiments.

IN THE DRAWINGS

Figure 1:
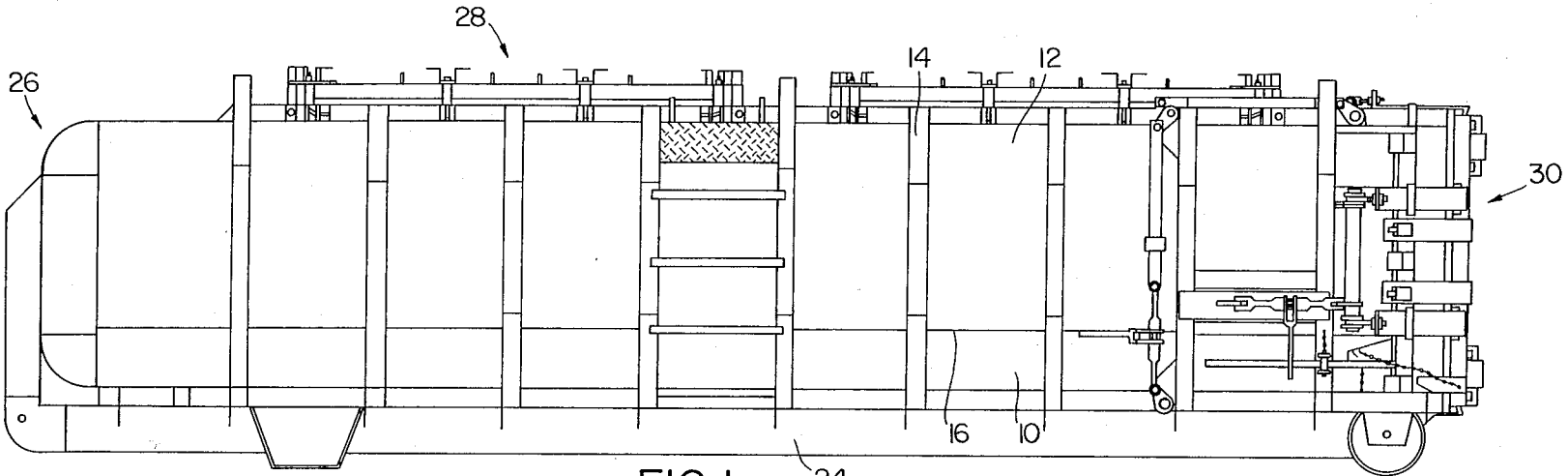

FIG. 1 is a side elevation of the container.

Figure 2:
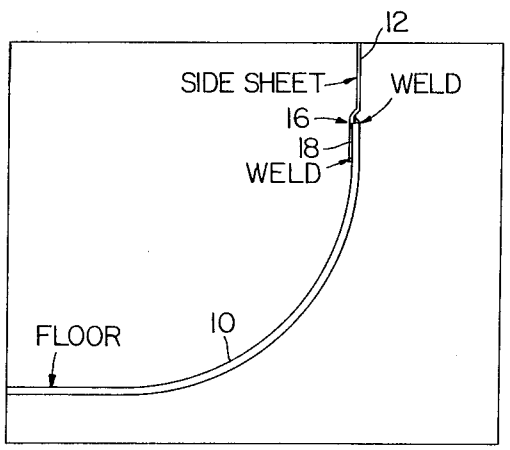

FIG. 2 is a cross section of the container showing the rounded upward side edges of the bottom plate and the weld of the rounded upward edges to the side pieces.

Figure 3:
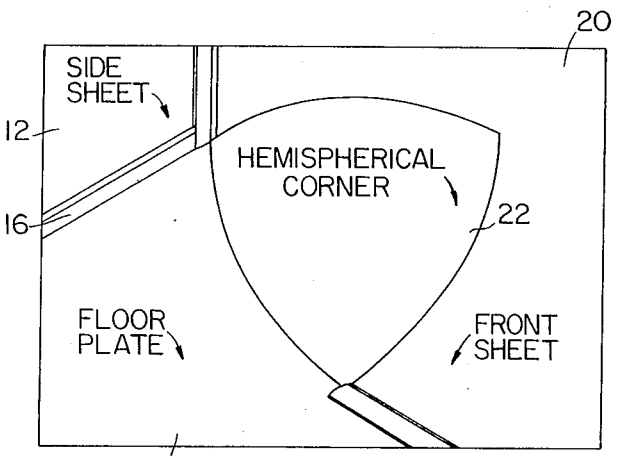

FIG. 3 is an interior view of a corner piece.

Figure 4:
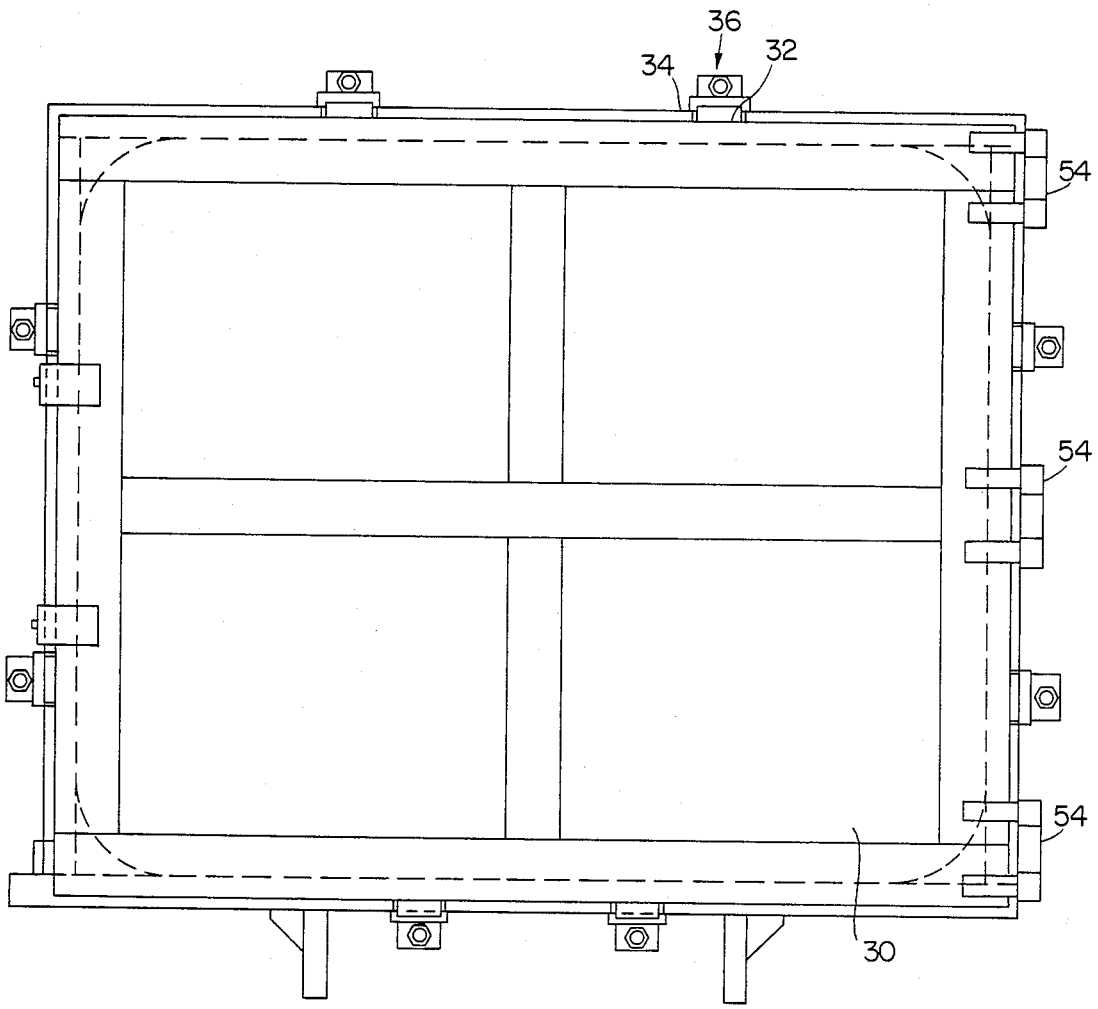

FIG. 4 is an end view of the door.

Figure 5:
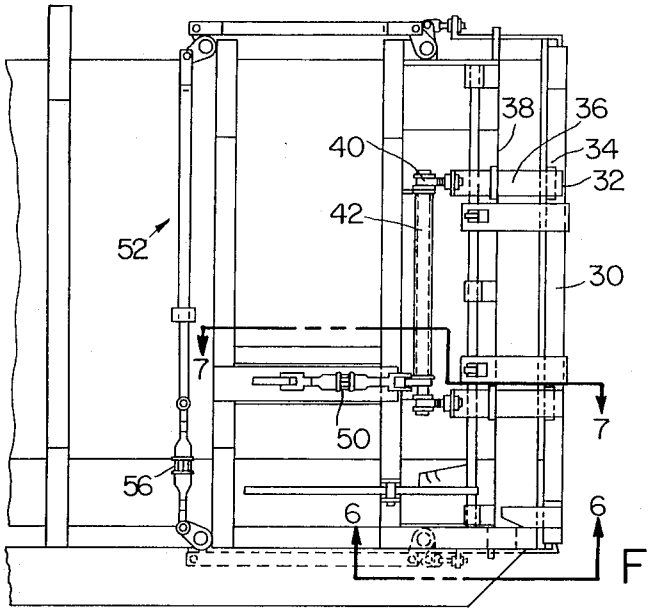

FIG. 5 is a partial side elevation of the container showing the latching mechanism.

Figure 6:
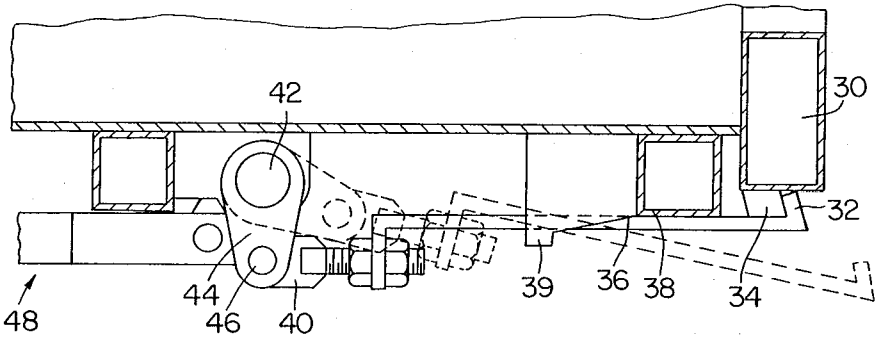

FIG. 6 illustrates the movement of the latch bar.

Figure 7:
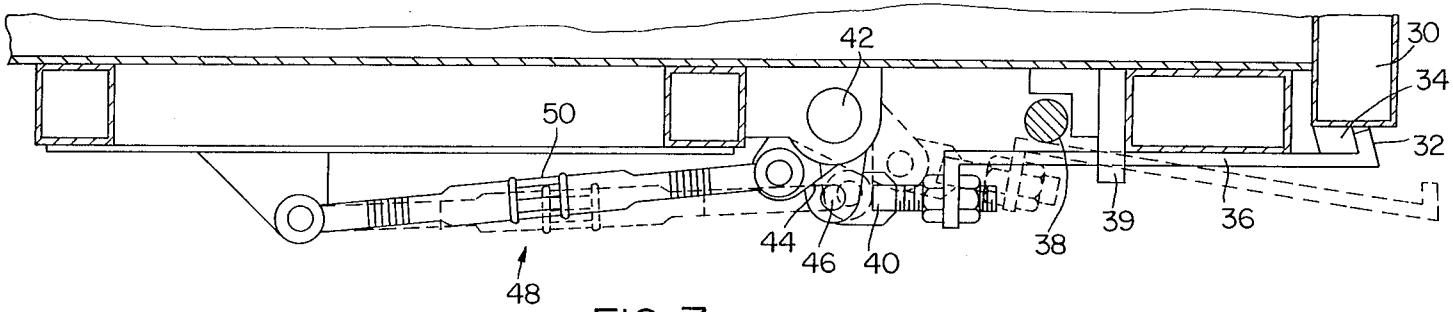

FIG. 7 illustrates the movement of the latch bar.

DESCRIPTION OF THE PREFERRED EMBODIMENT

FIG. 1 portrays a side elevation of the commercial waste container and disposal unit. In the preferred embodiment, the longitudinal side edges of bottom plate 10 are rounded upwards approximately 10 inches. Bottom plate 10 might be quarter inch steel plate. Side pieces 12 are welded to the rounded upward side edges of the bottom plate at 16. In the preferred embodiment the front end, which does not comprise the door, is rounded downward at the bottom to weld to the flat end of the bottom plate.

Construction efficiencies are achieved by not rounding upward the front end of the bottom plate. Since the front end is elevated during dumping, waste and moisture are less likely to be trapped along this bottom weld. Moreover, the front end is not located under the top hatches. There is little danger of impact from the deposit of heavy waste along this rounded downward front end. Nonetheless, in the preferred embodiment, the front end is constructed of heavier material than the sides.

FIG. 2 is a sectional view of the rounded upward side edges of the bottom plate and the weld of those edges with the side pieces. Side piece 12 is fashioned with lip 18 such that the side piece may be double welded to the rounded up edges of the bottom plate. This process yields a smooth exterior surface without external projections. The lack of external projections insures a smooth fit for channel pieces 14 along the exterior body of the container.

FIG. 3 is an interior view of a corner of the container containing bottom plate 10, side piece 12, end piece 20 and corner piece 22. Corner piece 22 is partially spherically shaped and welded on one side to bottom plate 10 and on two sides to end piece 20.

Returning to FIG. 1, structural assembly 24 and front assembly 26 are designed to interact with a compatable truck or truck and trailer, each having a hoist, such that the container may be lifted at the front assembly and positioned behind the truck. The container, loaded with waste through hatch assembly 28, will be hauled to disposal grounds and dumped through door assembly 30.

Door 30 is illustrated in FIG. 4 in an end view of the preferred embodiment. Door 30 is shown secured against the container by eight latch bars 36 whose end 32 presses against lugs 34 on the periphery of the door. The pressure seals the door against the container. In operation there is a seal compressed between the end of the container and the door.

FIG. 5 is a partial side elevation of the container illustrating the latching mechanism. In the closed position door 30 is held against the container by latches, of which latch 36 is an exemplification. End 32 presses against lug 34 located on the edge of the door. Latch 36 is released by turning ratchet 50 which rotates latch rod 42, thereby moving end 40 of latch bar 36 both toward the door and toward the side of the container. Latch bar 36 translates through and rotates around keeper fulcrum 38.

FIG.'s 6 & 7 illustrate the unlatching operation. Via mechanical connecting means 48, latch rod 42 and attached projection 44 rotate counterclockwise to release the latch. Projection 44 is swivelly connected to end 40 of latch bar 36 at point 46. As projection 44 rotates counterclockwise, end 40 of latch bar 36 moves toward door 30 of the container and toward the side wall of the container. Latch bar 36 rotates through and around fulcrum keeper combination 38 and 39. As end 40 moves toward the door and inward, end 32 moves away from the door and outward, away from the container. Pressure against door 30 is thereby released and door 30 may swing open on hinges, illustrated in FIG. 4, unimpeded.

Fulcrum keeper combination 38, 39 may be any combination of fulcrum and keeper. The fulcrum and keeper may be one and the same, as would be the case on a bottom latch underneath the door. In such a case the weight of the latch bar keeps it pressed against the keeper so that the keeper restrains the latch bar and acts as a fulcrum. On side or top latches it is convenient to provide a separate keeper 39 and fulcrum 38. The keeper restrains the latch bar's lateral movement while permitting translational movement. The latch bar rotates around the fulcrum as a pivot point. Any number of keeper fulcrum combinations are workable.

FIG. 5 and FIG. 7 illustrate ratchet 50 which may be turned to cause mechanical connecting means 48 to rotate rod 42 and projection 44.

FIG. 5 illustrates how mechanical connecting means 52 with ratchet 56 causes the rotation of the rod and projection which releases the latches on the top and the bottom of the container and door. It can be seen that a handler of the dumping operation can stand at the side of the container and effectively release pressure on door 30 such that the door may swing open, while yet standing well away from the path of debris that immediately leaks between door 30 and the container when the pressure is released.

While the particular embodiment of the invention has been shown and described, it will be understood that the invention is not limited thereto, since modifications may be made and will become apparent to those skilled in the art.

What is claimed is:

1. An improved commercial waste container and disposal unit which comprises:

a bottom plate of greater thickness than side pieces having at least two edges rounded upwards, such edges being welded to side pieces so that the weld is substantially above the bottom surface where fluids collect.

2. The waste container of claim 1 wherein the lower edges of the side pieces to be welded to the rounded upward edges of the bottom plate have a lip so that double welding such side pieces to the bottom plate results in an exterior surface without external projection.

3. The waste container of claim 1 wherein at least one corner of the container comprises a piece of partial spherical shape.

4. An improved commercial waste container and disposal unit having a door through which waste is emptied on one end of the container, the door being secured to the container by latch means comprising:

a latch bar which, in the closed position, presses the door against the container and, in the open position, permits the door to swing away from the container;

a latch rod attached to the container with a projection of the rod swivelly connected to a first end of the latch bar such that, upon rotation of the rod and projection, the latch bar moves from the closed position to the open position;

mechanical connection means attached to the rod which permits the rod to be rotated by the application of a mechanical force applied to a portion of the connection means located along a side of the container a distance away from the door; and a keeper fulcrum attached to the container and located between the two ends of the latch bar such that, as the rod and projection rotates, the latch bar translates along and rotates around the fulcrum, the translational and the rotational movement combining to move the second end of the latch bar in a direction away from the container, releasing pressure on the door, and in a direction away from the door, permitting the door to swing open unimpeded.

5. The waste container of claim 4 wherein the mechanical connection means includes a ratchet located on a side of the container a distance from the door such that as the ratchet is turned the latch rod rotates.

* * * * *